US008208834B2

(12) United States Patent
Yamaguchi

(10) Patent No.: US 8,208,834 B2
(45) Date of Patent: Jun. 26, 2012

(54) IMAGE FORMING APPARATUS HAVING REGULATING MECHANISM FOR REGULATING SWINGABLE RANGE OF SWINGABLE MEMBER

(75) Inventor: Takuya Yamaguchi, Toyokawa (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 562 days.

(21) Appl. No.: 12/411,837

(22) Filed: Mar. 26, 2009

(65) Prior Publication Data

US 2009/0252528 A1 Oct. 8, 2009

(30) Foreign Application Priority Data

Apr. 4, 2008 (JP) ..... 2008-098289

(51) Int. Cl.
*G03G 15/04* (2006.01)
*G03G 21/16* (2006.01)
*B41J 2/44* (2006.01)

(52) U.S. Cl. ..... 399/125; 399/218; 399/219

(58) Field of Classification Search ..... 399/118, 399/125, 218, 219
See application file for complete search history.

(56) References Cited

U.S. PATENT DOCUMENTS 6,434,350 B2 * 8/2002 Kikuchi et al. ..... 399/124
7,302,221 B2 * 11/2007 Shyu ..... 399/367
7,388,593 B2 * 6/2008 Fukuda ..... 347/138
7,656,421 B2 * 2/2010 Itabashi ..... 347/138
7,822,362 B2 * 10/2010 Watanabe et al. ..... 399/125
7,826,769 B2 * 11/2010 Yamaguchi ..... 399/125
7,840,159 B2 * 11/2010 Nakashima ..... 399/117
7,853,176 B2 * 12/2010 Itabashi ..... 399/125
7,957,666 B2 * 6/2011 Sato et al. ..... 399/107
7,962,061 B2 * 6/2011 Sato et al. ..... 399/107
7,991,325 B2 * 8/2011 Yamaguchi ..... 399/125
2001/0021321 A1 9/2001 Kikuchi et al.

FOREIGN PATENT DOCUMENTS

JP 05035003 A * 2/1993
JP 05-281795 10/1993
JP 2001-255803 9/2001
JP 2003-112446 4/2003
JP 2006018127 A * 1/2006
JP 2007-065125 3/2007

OTHER PUBLICATIONS

Notification of Reasons for Refusal for corresponding Japanese Patent Application 2008-098289 mailed on May 11, 2010.
Co-pending Commonly assigned U.S. Appl. No. 12/233,780, filed Sep. 19, 2008.

* cited by examiner

*Primary Examiner* — David Gray
*Assistant Examiner* — Fred L Braun
(74) *Attorney, Agent, or Firm* — Banner & Witcoff, Ltd.

(57) ABSTRACT

A first body houses a photoconductor is provided with a second body openably and closably attached to the first body. Additionally, a unit is provided to be swingable with respect to the second body such that an exposure surface of the unit is disposed at an exposure position opposing the photoconductor when the second body is closed. The exposure surface of the unit is disposed at a retreated position facing toward the rotary shaft of the second body when the first body is opened. Since the exposure surface of the unit faces toward the rotary shaft of the second body when the second body is opened, the exposure surface is not exposed to outside of the second body.

12 Claims, 18 Drawing Sheets

IMAGE FORMING APPARATUS HAVING REGULATING MECHANISM FOR REGULATING SWINGABLE RANGE OF SWINGABLE MEMBER

CROSS-REFERENCE TO RELATED APPLICATION

This application claims priority from Japanese Patent Application No. 2008-098289, filed on Apr. 4, 2008, the entire subject matter of which is incorporated herein by reference.

TECHNICAL FIELD

Aspects of the present invention relate to an image forming apparatus, such as an electrophotographic printer.

BACKGROUND

An image forming apparatus such as color printer employs an LED exposure method. For example, a color printer employing the LED exposure method, includes four drum units, which are provided corresponding to colors of yellow, magenta, cyan, and black and are disposed in parallel in an apparatus body, and an LED head, which is provided corresponding to each of the drum units and includes a plurality of LEDs arrayed linearly.

A stacker cover is provided on an upper surface of the apparatus body. The stacker cover is supported on a rotary shaft extending along the upper edge of the apparatus body and rotates about the rotary shaft so that the upper surface of the apparatus body can be opened and closed. The four LED heads are attached to the stacker cover. When the stacker cover is closed, each LED head opposes a photoconductor, which is provided in the corresponding drum unit, from above. In addition, when the stacker cover is opened, the LED heads are disposed outside the apparatus body. In this state, each drum unit can be exchanged (for example, refer to JP-A-2003-112446).

SUMMARY

However, when the stacker cover is opened, an exposure surface (surface opposing a photoconductor) of the LED head is exposed outside opposite to the rotary shaft side of the stacker cover. Therefore, there occurs a problem that the exposure surface of the LED head is damaged, or dust adheres to the exposure surface of the LED head.

In order to address the problem, the inventor of the present application proposed a configuration in which a first body that houses a photoconductor therein and a second body openably and closably attached to the first body are provided. Additionally, an LED unit is provided to be swingable with respect to the second body such that an exposure surface of the LED unit is disposed at an exposure position opposing the photoconductor when the second body is closed, and the exposure surface of the LED unit is disposed at a retreated position facing toward the rotary shaft of the second body when the first body is opened. According to this proposed configuration, since the exposure surface of the LED unit faces toward the rotary shaft of the second body when the second body is opened, the exposure surface is not exposed to outside of the second body. Accordingly, it can be suppressed that the exposure surface is damaged or dust adheres to the exposure surface.

However, if the second body is closed roundly, the LED unit rotates fast such that the exposure surface of the LED moves fast from the retreated position to the exposure position. Then, the exposure surface of the LED unit does not stop appropriately at the exposure position, and the LED unit largely swings close to the exposure position. As a result, there is a possibility that the LED unit would interfere with other components disposed in the apparatus body.

Accordingly, it is an aspect of the present invention to provide an image forming apparatus capable of preventing undesired swing of a swingable member when the second body is displaced from an open posture to a closed posture, and the swingable member swings from an adjacent posture to a distant posture with the displacement.

According to an exemplary embodiment of the present invention, there is provided an image forming apparatus comprising: a first body formed with an opening; a second body which is supported on the first body, and which is rotatable about an axis between an open posture in which the opening is opened and a closed posture in which the opening is closed; a swingable member which comprises one end swingably supported on the second body, and another end opposite to the one end, wherein the swingable member takes a distant posture in which the other end is distant from the second body when the second body is in the closed posture, wherein as the second body is rotated from a first angle position at which the second body is rotated by a first angle from the closed posture, toward the open posture, the swingable member swings from the distant posture toward an adjacent posture in which the other end is closer to the second body than the distant posture, and wherein as the second body is rotated from the open posture toward the first angle position, the swingable member swings toward the distant posture; and a regulating mechanism which regulates a swingable range of the swingable member when the second body is rotated from a third angle position at which the second body is rotated by a third angle from the closed posture, toward the closed posture.

According to another exemplary embodiment of the present invention, there is provided an image forming apparatus comprising: a first body comprising an opening and a shaft provided at one end of the opening; a second body rotatably supported by the shaft between an open posture in which the opening is opened and a closed posture in which the opening is closed; an operation member which is slidably supported on the second body; an arm comprising one end which is connected to the first body and another end opposite to the one end, the other end connected to the operation member to be slidable with respect to the second body; a movable member which is movably supported on the second body, and includes an engagement part, wherein the movable member is moved by the operation member; a swingable member comprising a first portion rotatably supported on the second body and a second portion rotatably supported on the movable member; and a regulating mechanism which is moved by contacting the operation member, and includes an engagement part engageable with the engagement part of the movable member.

BRIEF DESCRIPTION OF THE DRAWINGS

The above and other aspects of the present invention will become more apparent and more readily appreciated from the following description of exemplary embodiments of the present invention taken in conjunction with the attached drawings, in which.

DETAILED DESCRIPTION

Hereinafter, an exemplary embodiment of the present invention will be described in detail with reference to the accompanying drawings.

1. Entire Configuration of a Color Laser Printer

Figure 1:
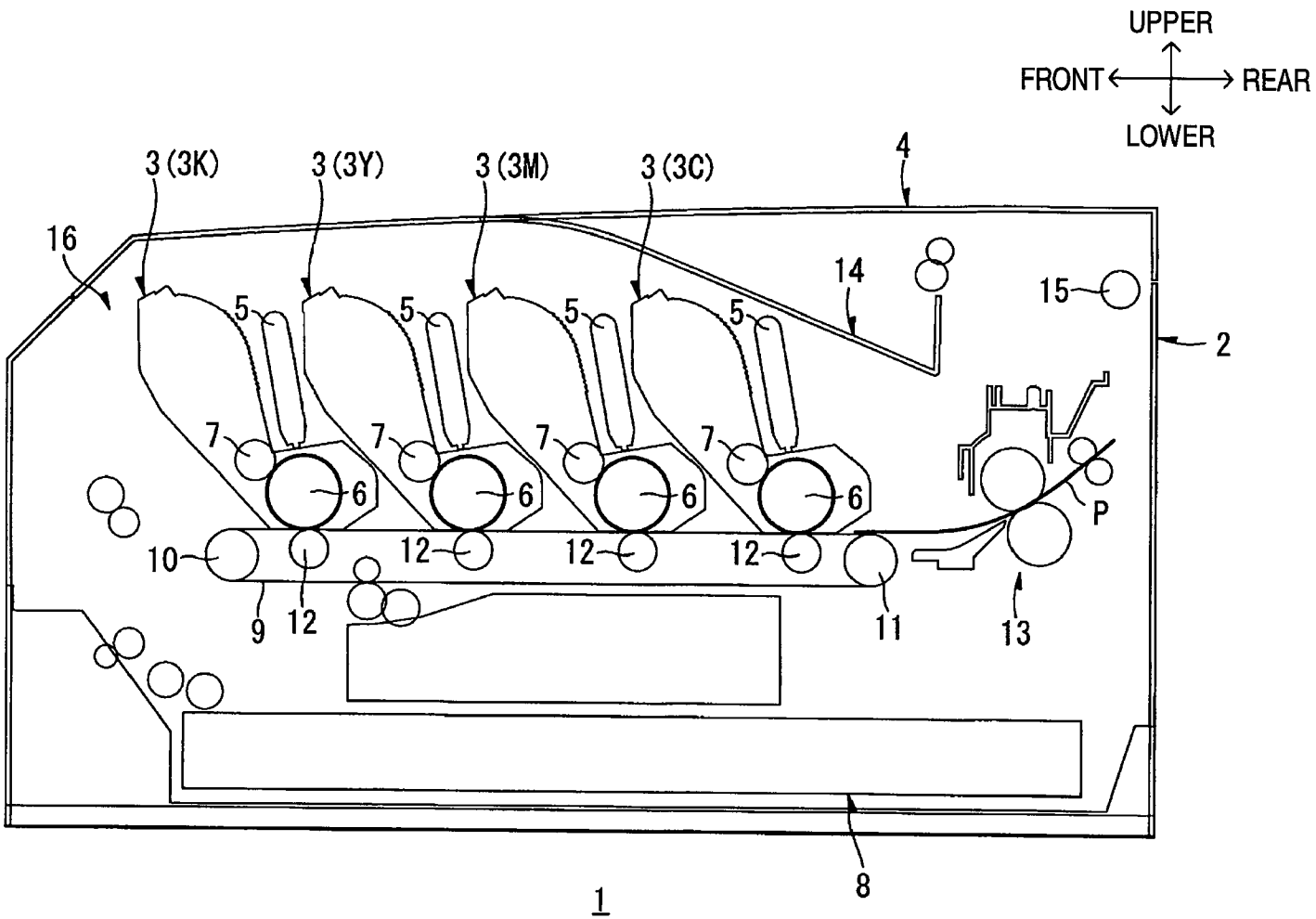
FIG. 1 is a side sectional view showing a printer according to an exemplary embodiment of the present invention.
Figure 2:
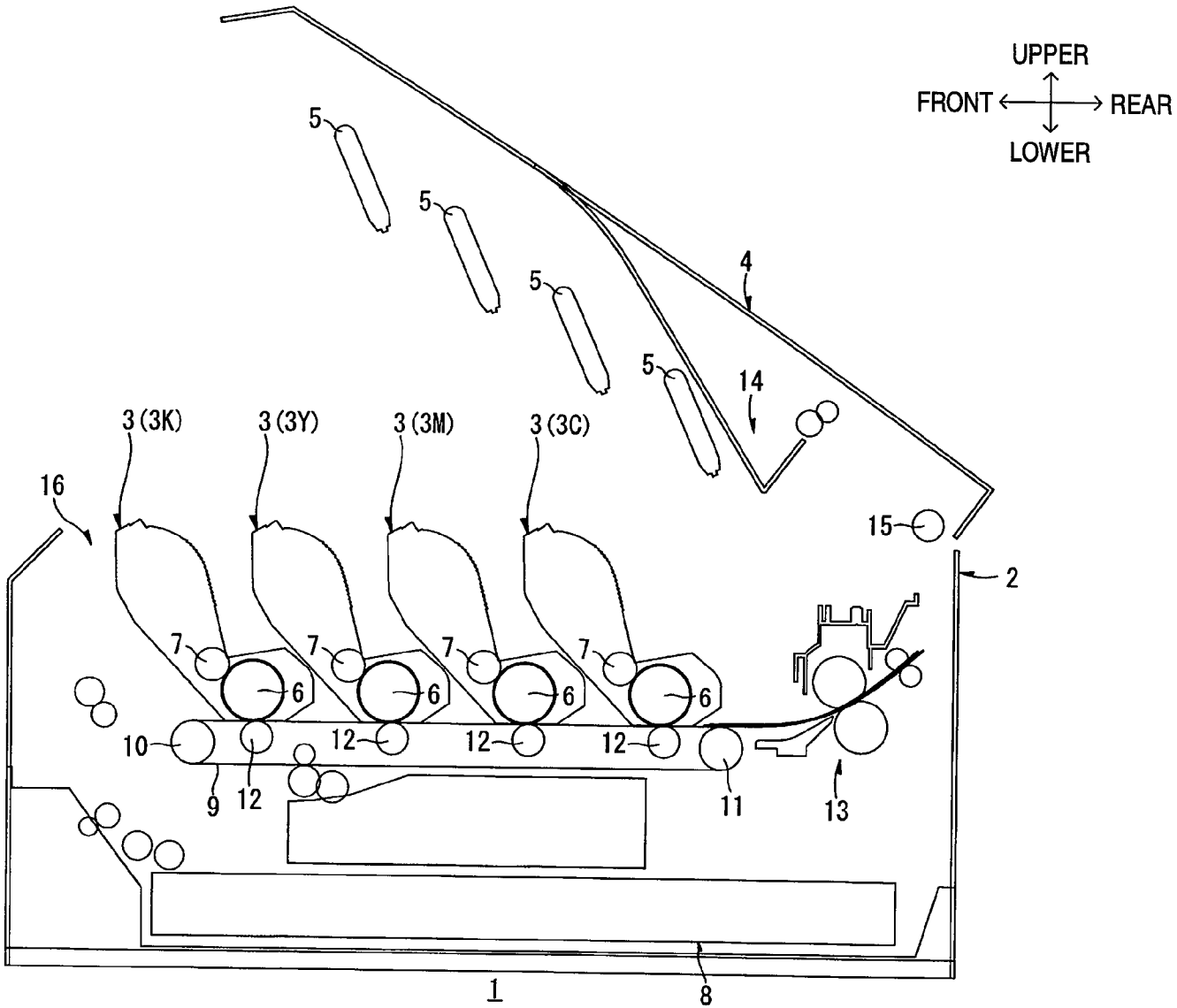
FIG. 2 is a side sectional view showing a state where a top cover is opened in the printer shown in FIG. 1.

FIG. 1 is a side sectional view showing a printer 1 according to an exemplary embodiment of the present invention. FIG. 2 is a side sectional view showing a state where a top cover 4 is opened in the printer 1 shown in FIG. 1.

A printer 1 is a tandem color laser printer. The printer 1 includes a main body casing 2 as an example of a first body and a top cover 4 as an example of a second body. The main body casing 2 is formed in the shape of a box formed with an opening 16 on an upper surface. The top cover 4 is rotatably supported on a rotatable shaft 15 provided on the upper end of the main body casing 2. The top cover 4 is rotatably supported to be displaceable between a closed posture in which the opening 16 is closed and an open posture in which the opening 16 is opened, according to the rotating operation thereof.

In the main body casing 2, four drum units 3 are disposed in parallel. The drum units 3 are provided corresponding to colors of black, yellow, magenta, and cyan and are arrayed in order of black, yellow, magenta, and cyan in the conveyance direction of a sheet P using a conveyance belt 9, which will be described later. Each drum unit 3 can be mounted in the main body casing 2 or removed from the main body casing 2 through the opening 16, which is formed on the upper surface of the main body casing 2, when the top cover 4 is in the open posture.

It is noted that, for the drum units 3, K (black), Y (yellow), M (magenta), and C (cyan) indicating respective colors are added to ends of reference numerals in FIGS. 1 and 2.

Each drum unit 3 includes a photosensitive drum 6 as an example of a photoconductor and a developing roller 7. A surface of the photosensitive drum 6 is uniformly charged by a scorotron-type charger (not shown) as the photosensitive drum 6 rotates.

On the other hand, LED units 5 are rotatably supported on the top cover 4. Four LED units 5 are disposed in parallel corresponding to the drum units 3. The tip of each LED unit 5 is disposed at a position facing a circumferential surface of the photosensitive drum 6 when the top cover 4 is in the closed posture. In addition, the LED units 5 are retracted from the inside of the main body casing 2 when the top cover 4 is in the open posture. In this case, the tip of the LED unit 5 faces toward the rotatable shaft 15 of the main body casing 2 as shown in FIG. 2.

The photosensitive drum 6 uniformly charged by the scorotron-type charger is selectively exposed by the LED units 5. By this exposure, electric charges are selectively removed from the surface of the photosensitive drum 6. As a result, an electrostatic latent image is formed on the surface of the photosensitive drum 6. A developing bias is applied to the developing roller 7. When the electrostatic latent image faces the developing roller 7, toner is supplied from the developing roller 7 to the electrostatic latent image due to the potential difference between the electrostatic latent image and the developing roller 7. As a result, a toner image is formed on the surface of the photosensitive drum 6.

In addition, a sheet feed cassette 8 in which the sheet P is set is disposed on a bottom portion of the main body casing 2. The sheet P set in the sheet feed cassette 8 is conveyed on the conveyance belt 9 by various rollers. The conveyance belt 9 is wound around a pair of driving roller 10 and driven roller 11 and is disposed to face the four photosensitive drums 6 from the lower side. A transfer roller 12 is disposed at a position facing each photosensitive drum 6 with an upper part of the conveyance belt 9 interposed therebetween. The sheet P conveyed on the conveyance belt 9 passes between the conveyance belt 9 and the photosensitive drums 6 sequentially as the conveyance belt 9 travels. Then, a toner image on the surface of the photosensitive drum 6 is transferred onto the sheet P by a transfer bias applied to the transfer roller 12 when the toner image faces the sheet P.

A fixing unit 13 is provided at a downstream side of conveyance belt 9 in the conveyance direction of the sheet P. The sheet P on which the toner image is transferred is conveyed to the fixing unit 13. In the fixing unit 13, the toner image is fixed on the sheet P by heat and pressure. The sheet P on which the toner image is fixed is discharged to a sheet discharge tray 14 on the upper surface of the main body casing 2 by various rollers.

It is noted that, in a state where the top cover 4 is closed, an upstream side in the conveyance direction of the sheet P using the conveyance belt 9 is taken as a front side of the printer 1. Left and right sides in the printer 1 is determined when the printer 1 is viewed from the front side. In each drawing, arrows indicating front and rear, upper and lower, and left and right directions are shown.

2. Top Cover

Figure 3:
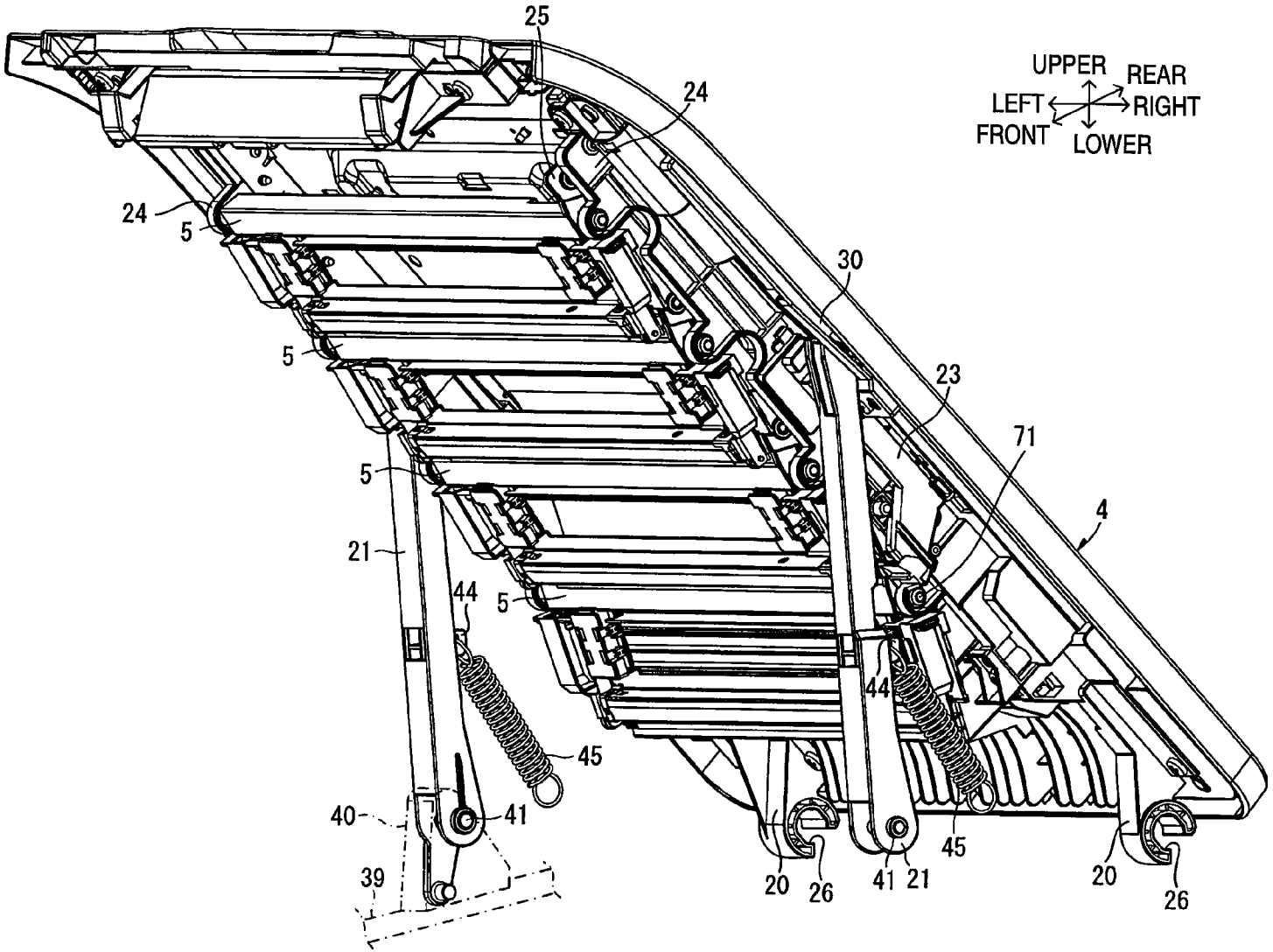
FIG. 3 is a perspective view showing a state where the top cover is opened in the printer shown in FIG. 1.
Figure 4:
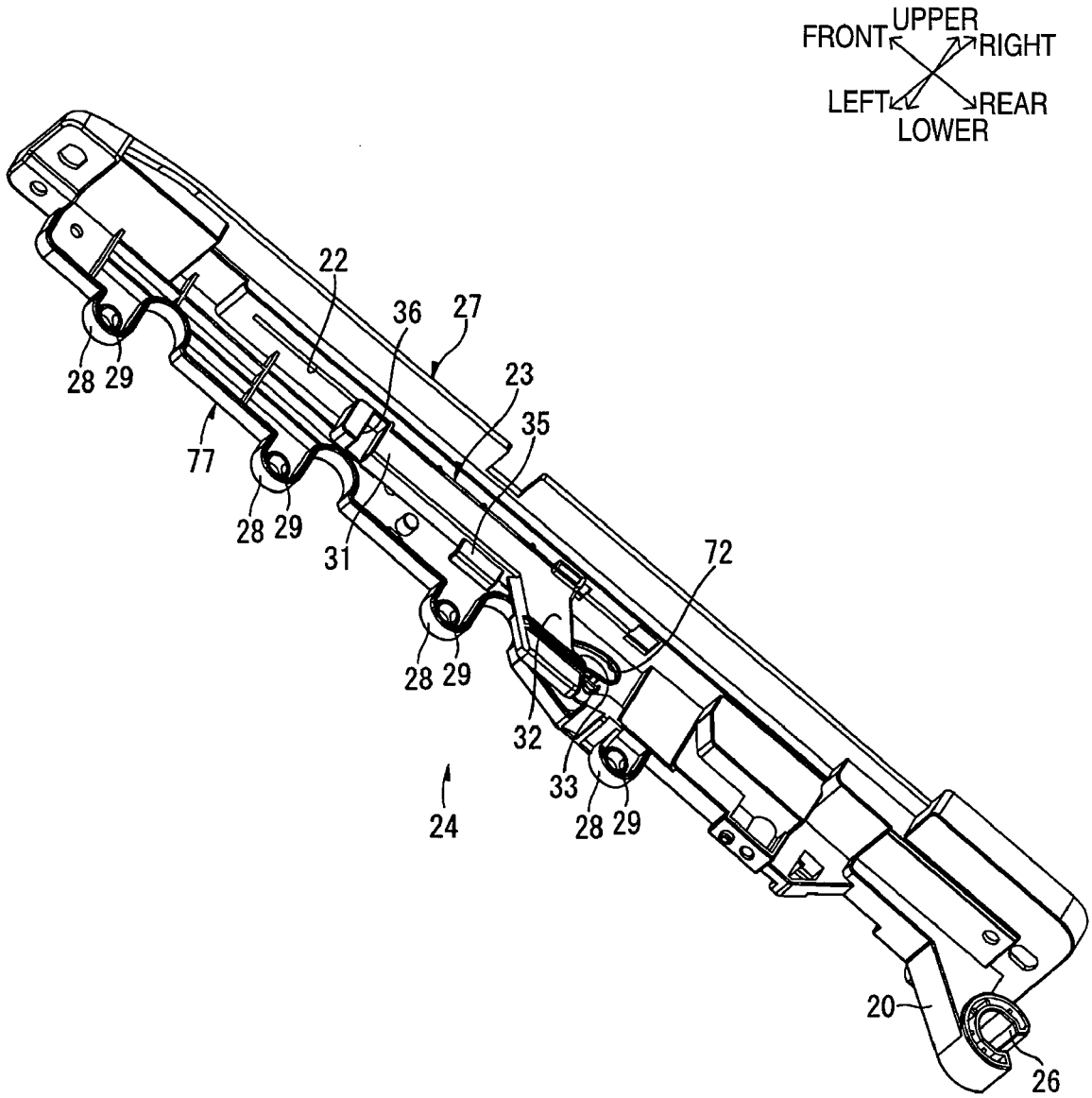
FIG. 4 is a perspective view showing a right cover side plate.

FIG. 3 is a perspective view showing a state where the top cover 4 is opened in the printer shown in FIG. 1. FIG. 4 is a perspective view showing a right cover side plate.

The top cover 4 is formed in an approximately rectangular plate shape in plan view. A pair of cover side plates 24 that support the four LED units 5 rotatably and collectively is attached to the top cover 4.

On a bottom surface of the top cover 4, the pair of cover side plates 24 are disposed spaced apart therebetween in the left and right direction (hereinafter, also referred to as a width direction). As shown in FIG. 4, each cover side plate 24 includes a mounting plate 27, which extends in the front and rear direction and has an approximately rectangular plate shape in plan view, and a support plate 77, which extends downward from an inner edge portion of the mounting plate 27 in the width direction and has a rectangular plate shape in side view.

The mounting plate 27 is attached to the bottom surface of the top cover 4 by an attaching screw (not shown) in a state where an upper surface of the mounting plate 27 is in contact with the bottom surface of the top cover 4.

A connecting portion 20 is formed at the rear end of the mounting plate 27. The connecting portion 20 is formed in a triangular plate shape in side view protruding from the mounting plate 27 downward from the rear side. An annular rotatable shaft housing portion 26 is formed at a rear-side lower end of the connecting portion 20. The rotatable shaft housing portion 26 has a C shape in side view while a rear-side portion of the rotatable shaft housing portion 26 is cut. The rotatable shaft 15 (refer to FIG. 1) provided in the main body casing 2 is rotatably fitted in the rotatable shaft housing portion 26. As a result, the cover side plate 24 (top cover 4) is rotatably supported around the rotatable shaft 15.

At the lower end of the support plate 77, four LED support portions 28 are formed with equal distances therebetween in the front and rear direction. Each LED support portions 28 is formed in a semicircular shape in side view protruding downward from the lower end of the support plate 77. An LED support hole 29 is formed to pass through the LED support portion 28 in the width direction.

A movable boss hole 72 formed in the arc from the upper end of the cover side plate 24 downward to the front side is formed between the rearmost LED support hole 29 of the support plate 77 of the right cover side plate 24 and the LED support hole 29 in front of the rearmost LED support hole 29. A movable boss 71, which will be described later, is inserted in the movable boss hole 72.

A slide rail 22 is formed in a middle portion of the mounting plate 27 of the right cover side plate 24 in the front and rear direction. The slide rail 22 is formed in a long and narrow hole shape that extends frontward from the approximately middle of the mounting plate 27 and passes through the mounting plate 27 in the up and down direction.

As shown in FIG. 3, an operation member 23 that is slidable along the slide rail 22 and an arm regulating member 30 for regulating the slide range of an arm 21, which will be described later, are attached to the right cover side plate 24.

(1) Operation Member

Figure 5:
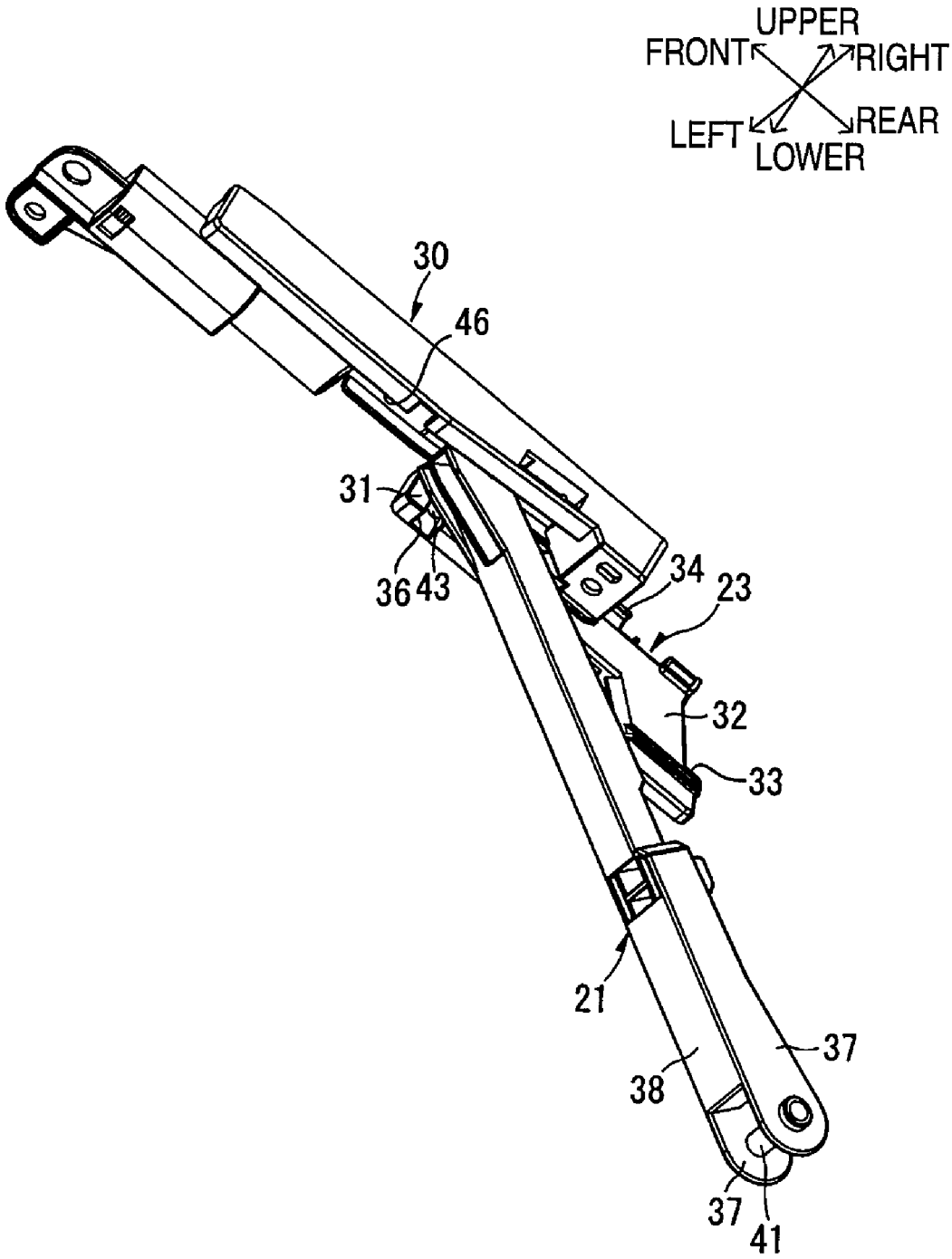
FIG. 5 is a perspective view showing the positional relationship of an arm regulating member, an operation member, and an arm.

FIG. 5 is a perspective view showing the positional relationship of the arm regulating member 30, an operation member 23, and the arm 21.

As shown in FIGS. 4 and 5, the operation member 23 includes a main body 31, which extends in the front and rear direction and has an approximately rectangular plate shape in side view, and an inclined portion 32, which extends from the rear end of the main body 31 downward to the rear side and has an approximately parallelogram shape in side view. A contact portion 33 which protrudes rearward and whose rear end surface is inclined is formed at the lower end of the inclined portion 32.

A slider 34 that extends in the front and rear direction and has a T shape in front view is formed on an upper surface of the main body 31. Since an upper portion of the slider 34 is disposed on the slide rail 22 of the cover side plate 24 and a lower portion (portion connected with the main body 31) of the slider 34 is exposed downward from the slide rail 22, the operation member 23 becomes slidable along the slide rail 22.

As shown in FIG. 4, an L rib 35 having an L shape is formed in front of the inclined portion 32 on a bottom surface of the main body 31. The L rib 35 extends downward from the bottom surface of the main body 31 and is bent from the lower end inward in the width direction. The tip of the L rib 35 faces a locking lever 65 of a locking member 59, which will be described later, in the front and rear direction.

Further, as shown in FIG. 4, a groove 36 in which an arm boss 43, which will be described later, is inserted is formed on a right side surface of the front end of the main body 31. The lower end of the groove 36 is open downward.

(2) Arm

The main body casing 2 includes a pair of main body side plates 39 facing each other and spaced apart in the left and right direction. A support portion 40 having a triangular shape in side view is formed at the upper end of each of the main body side plates 39 (shown by an imaginary line in FIG. 3). A support shaft hole (not shown) is formed to pass through the support portion 40 in the width direction.

The arm 21 is formed in a long and narrow quadrangular prism shape and includes a pair of arm side plates 37 facing each other in the left and right direction and an arm connecting plate 38 that connects the arm side plates 37 to each other. An arm shaft 41 is provided between one ends of the arm side plates 37. The arm shaft 41 is rotatably inserted in a support shaft hole of the support portion 40. Accordingly, the arm 21 is rotatably supported around the arm shaft 41 with respect to the main body casing 2.

As shown in FIG. 5, at the other end of the right arm 21, an arm boss 43 protruding inward in the width direction is formed on the arm side plate 37 at the inner side in the width direction. The arm boss 43 of the right arm 21 is fitted in the groove 36 of the operation member 23. Thus, the other end of the right arm 21 is connected to the cover side plate 24 (top cover 4) to be slidable integrally with the operation member 23.

As shown in FIG. 3, a hook-like spring locking portion 44 that protrudes rearward and is bent upward in a state where the arm 21 is erected with respect to the main body casing 2 is formed in a middle portion of the arm connecting plate 38. One end of an arm spring 45 is locked to the spring locking portion 44. The other end of the arm spring 45 is locked to a locking portion (not shown) provided at the rear end of the main body side plate 39. Accordingly, the arm 21 is urged rearward by the arm spring 45.

(3) Arm Regulating Member

The arm regulating member 30 is attached to a bottom surface of the mounting plate 27 of the cover side plate 24. The arm regulating member 30 is formed in an approximately rectangular long and narrow plate shape in plan view, as shown in FIG. 5. An arm regulating groove 46 which extends in the front and rear direction and has front and rear ends blocked is formed on a bottom surface of the arm regulating member 30. The other end of the arm 21 is inserted in the arm regulating groove 46 in a state where the arm boss 43 provided at the other end of the arm 21 is fitted in the groove 36 of the operation member 23. Accordingly, since the arm 21 is movable within a range corresponding to the length of the arm regulating groove 46 in the front and rear direction, the movement beyond the range is regulated.

3. Opening and Closing Operations of a Top Cover

Figure 6:
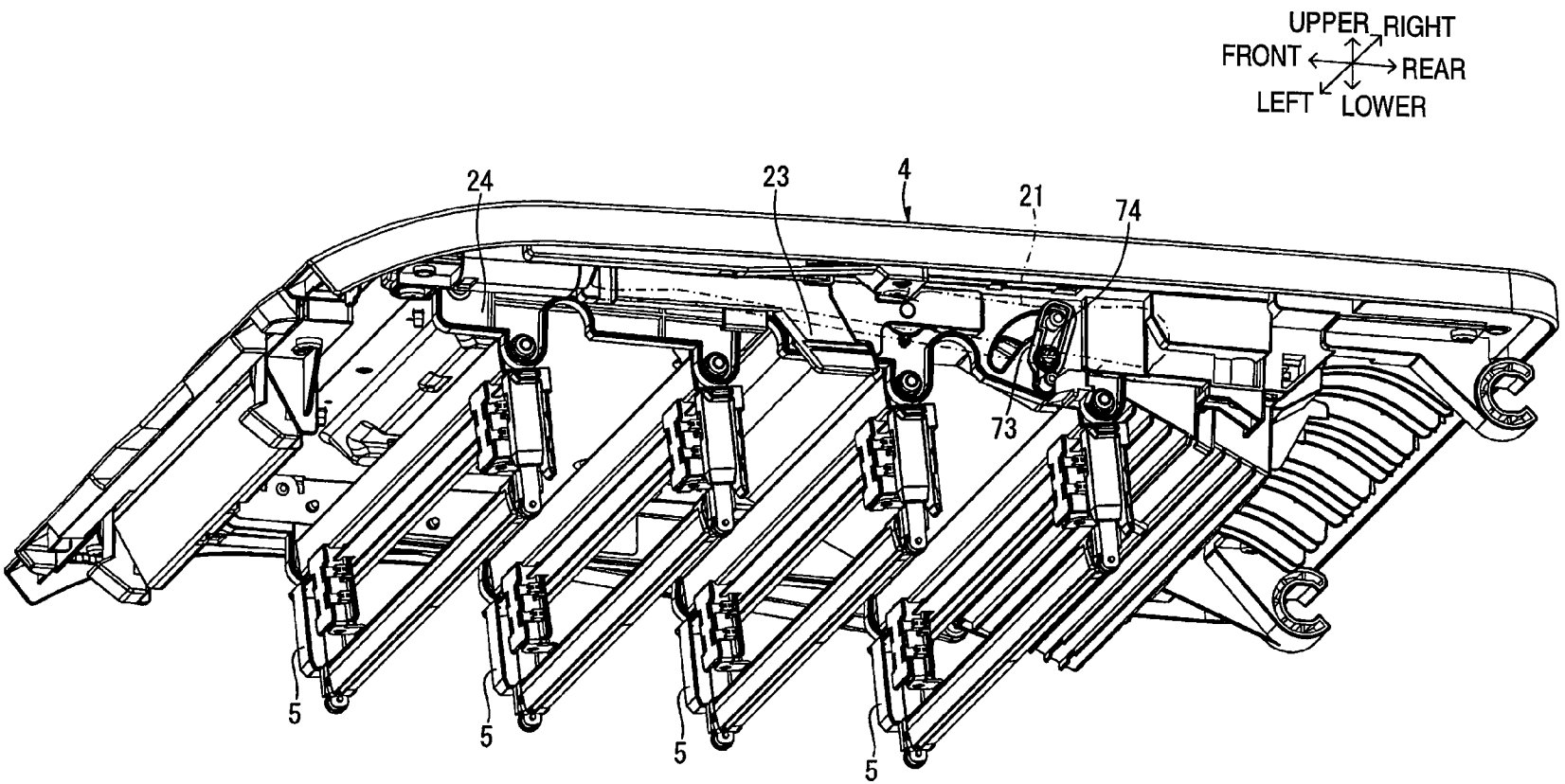
FIG. 6 is a perspective view showing a state where the top cover is in the closed posture.
Figure 7:
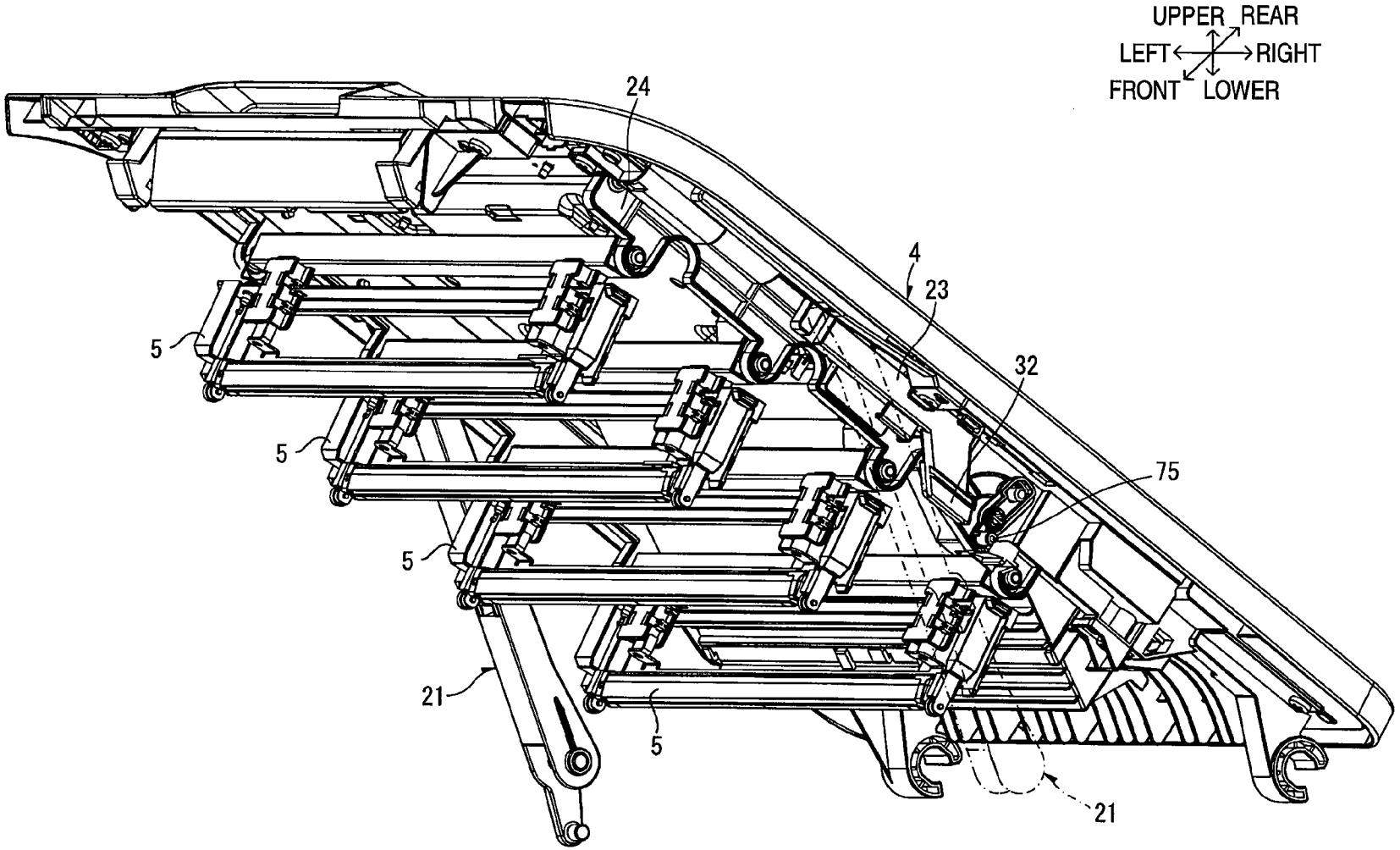
FIG. 7 is a perspective view showing a state where the top cover is disposed at a second angle position rotated by a second angle from the closed posture.
Figure 8:
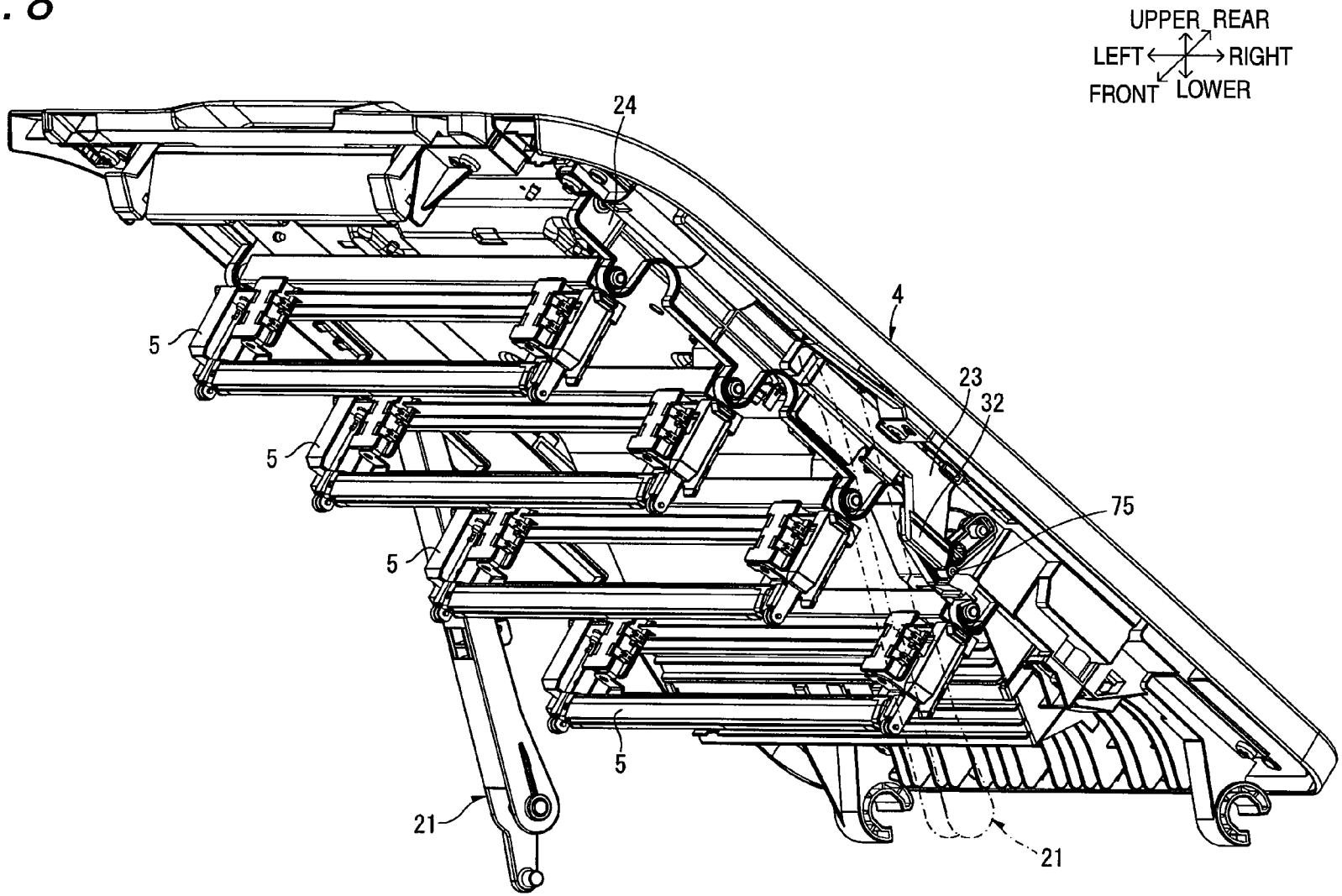
FIG. 8 is a perspective view showing a state where the top cover is disposed at a first angle position rotated by a first angle from the closed posture.
Figure 9:
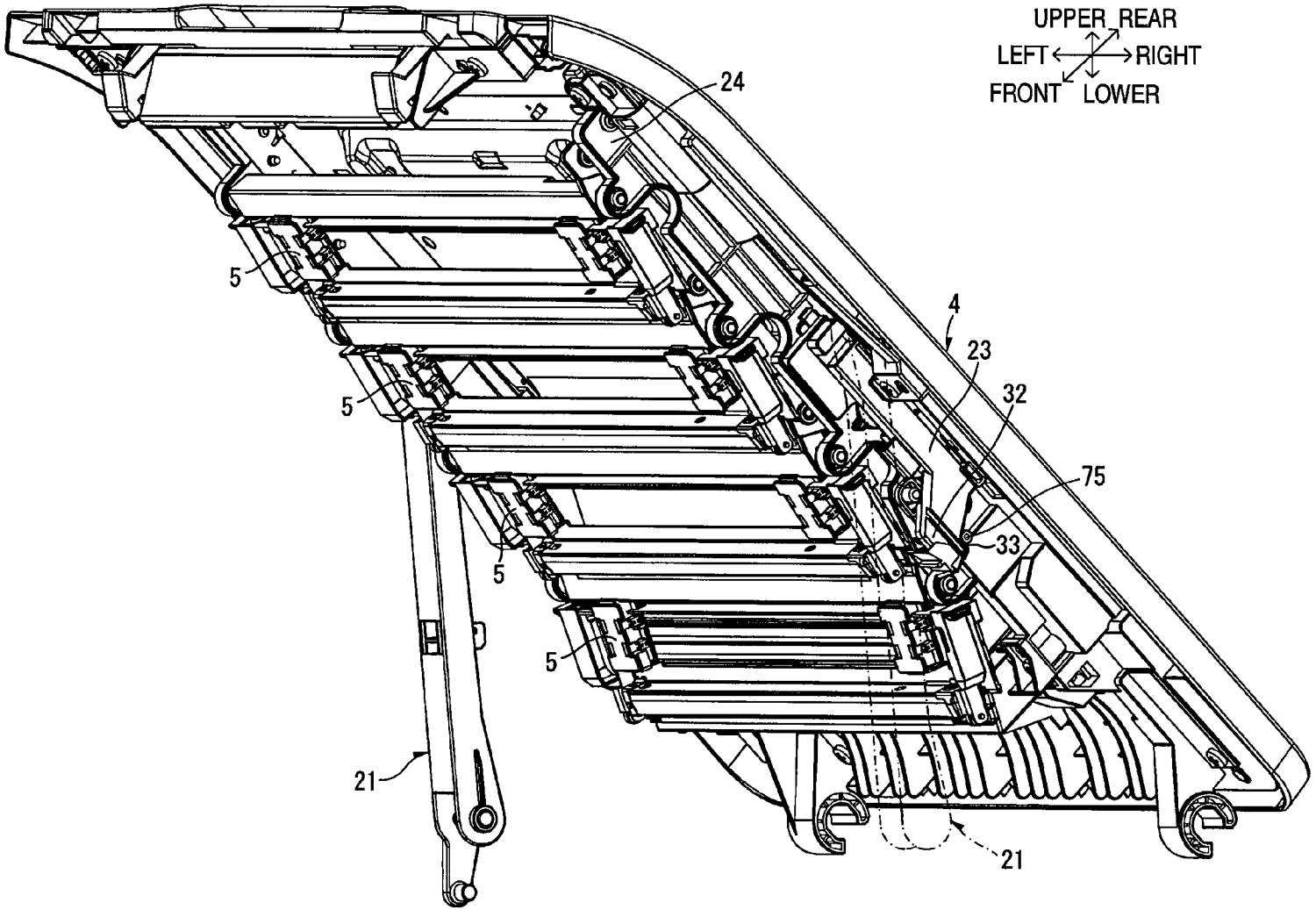
FIG. 9 is a perspective view showing a state where the top cover is in the open posture.

FIG. 6 is a perspective view showing a state where the top cover 4 is in the closed posture. FIG. 7 is a perspective view showing a state where the top cover 4 is disposed at a second angle position rotated by a second angle from the closed posture. FIG. 8 is a perspective view showing a state where the top cover 4 is disposed at a first angle position rotated by a first angle from the closed posture. FIG. 9 is a perspective view showing a state where the top cover 4 is in the open posture.

Hereinafter, an operation of the top cover 4 will be described mainly referring to FIGS. 6 to 9. In each drawing, the right arm 21 is shown by an imaginary line for the simplicity purpose.

As shown in FIG. 6, when the top cover 4 is in the closed posture, each arm 21 has approximately horizontal posture and the other end of the right arm 21 is disposed at the front end of the arm regulating groove 46. The operation member 23 is disposed at the front end within a slidable range.

In this state, the tip of each LED unit 5 is separated from the top cover 4 to be disposed at a distant position at which the LED unit 5 can expose a surface of the photoconductor drum 6 (refer to FIG. 1).

When the top cover 4 rotates from this state, the other end of each arm 21 slides rearward to cause each arm 21 to rotate in a direction erecting with respect to the main body casing 2, as shown in FIG. 7. The operation member 23 moves rearward with the movement of the other end of the right arm 21.

When the top cover 4 is disposed at the first angle position rotated by the first angle (for example, 40°) from the closed posture, the inclined portion 32 comes in contact with a link boss 75, which will be described later, from the front side as shown in FIG. 8.

When the top cover 4 further rotates in this state, the other end of each arm 21 further slides rearward to cause each arm 21 to rotate in the direction erecting with respect to the main body casing 2, as shown in FIG. 9. The operation member 23 further moves rearward with the movement of the other end of the arm 21, and the link boss 75 is guided to the inclined surface of the contact portion 33 to ride on the contact portion 33.

In the state where the top cover 4 is in the open posture, the tip of each LED unit 5 is adjacent to the top cover 4 and is disposed at the adjacent position facing toward a side of the rotatable shaft 15 (refer to FIG. 1).

4. LED Unit

Figure 10:
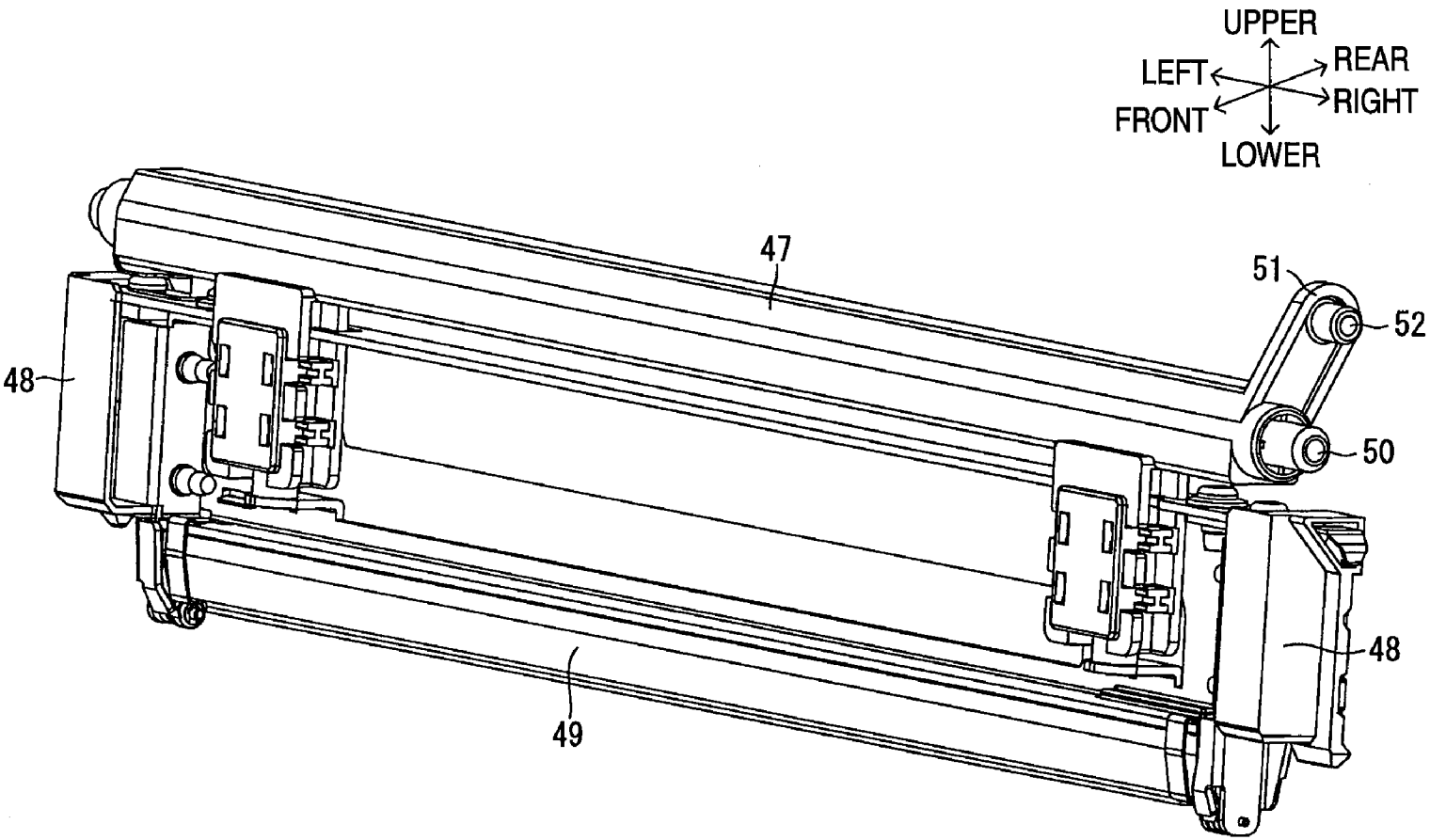
FIG. 10 is a perspective view showing an LED unit.

FIG. 10 is a perspective view showing the LED unit 5. The LED unit 5 includes an LED head 49, two holders 48 for holding the LED head 49, and a connecting member 47 for connecting the holders 48.

The LED head 49 is formed in an approximately inverted triangle shape in side view extending in the width direction. In addition, the LED head 49 is formed by unitizing an LED array (not shown) arrayed linearly along the main-scanning direction (width direction) and a SELFOC lens array (not shown). A bottom surface of the LED head 49 is configured as an exposure surface from which light is emitted.

Each holder 48 is formed in an approximately rectangular shape in side view extending in a direction perpendicular to the longitudinal direction of the LED unit 49. In addition, the LED head 49 is held between one ends of the holders 48.

The connecting member 47 is formed in a rod shape extending in the width direction and is disposed between the other ends of the holders 48. Swinging bosses 50 protruding outward in the width direction are formed at both ends of the connecting member 47 in the width direction. As shown in FIG. 3, since the swinging boss 50 is inserted in the LED support hole 29 of each cover side plate 24, the LED unit 5 is supported to be swingable with respect to the cover side plate 24(top cover 4).

As shown in FIG. 10, an arm portion 51 protruding upward to the rear side is formed on a right end surface of the connecting member 47. A displacement boss 52 protruding outward in the width direction is formed on a protruding end of the arm portion 51. The displacement boss 52 is swingably supported on a movable member 53, which will be described later.

5. Movable Member

Figure 11:
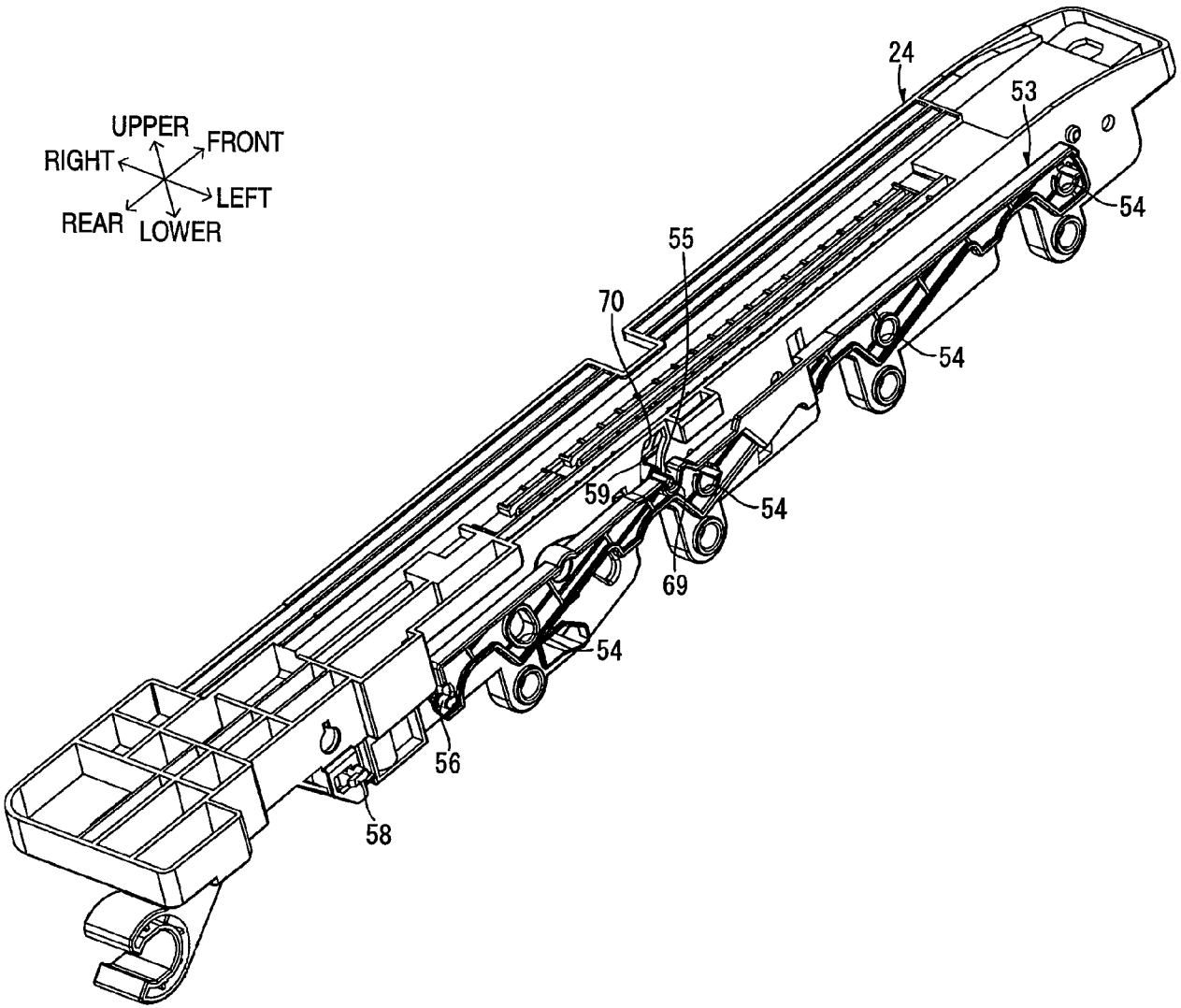
FIG. 11 is a perspective view showing a cover side plate and a movable member when the top cover is in the closed posture.
Figure 12:
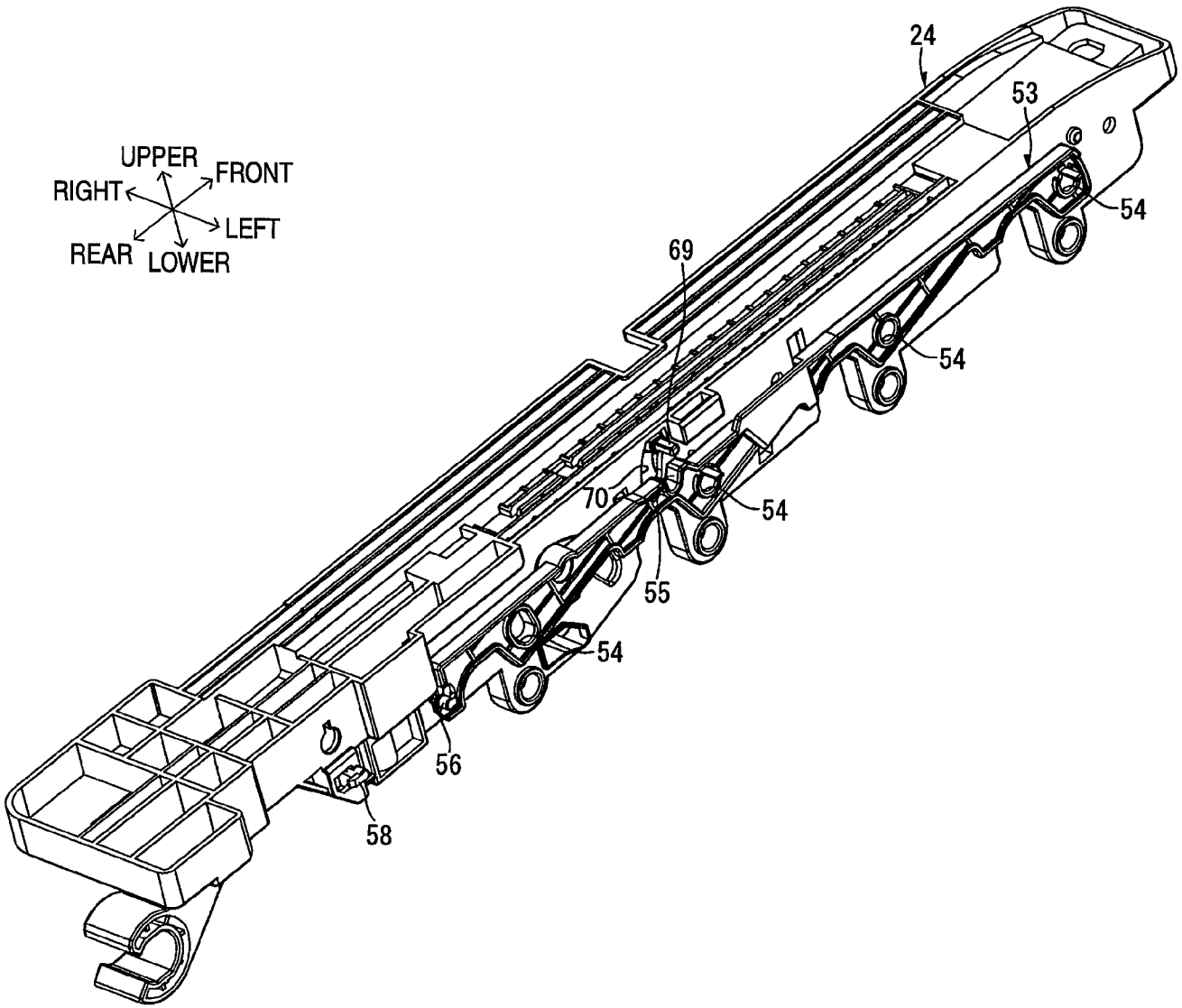
FIG. 12 is a perspective view showing the cover side plate and the movable member when the top cover is in the open posture.
Figure 13:
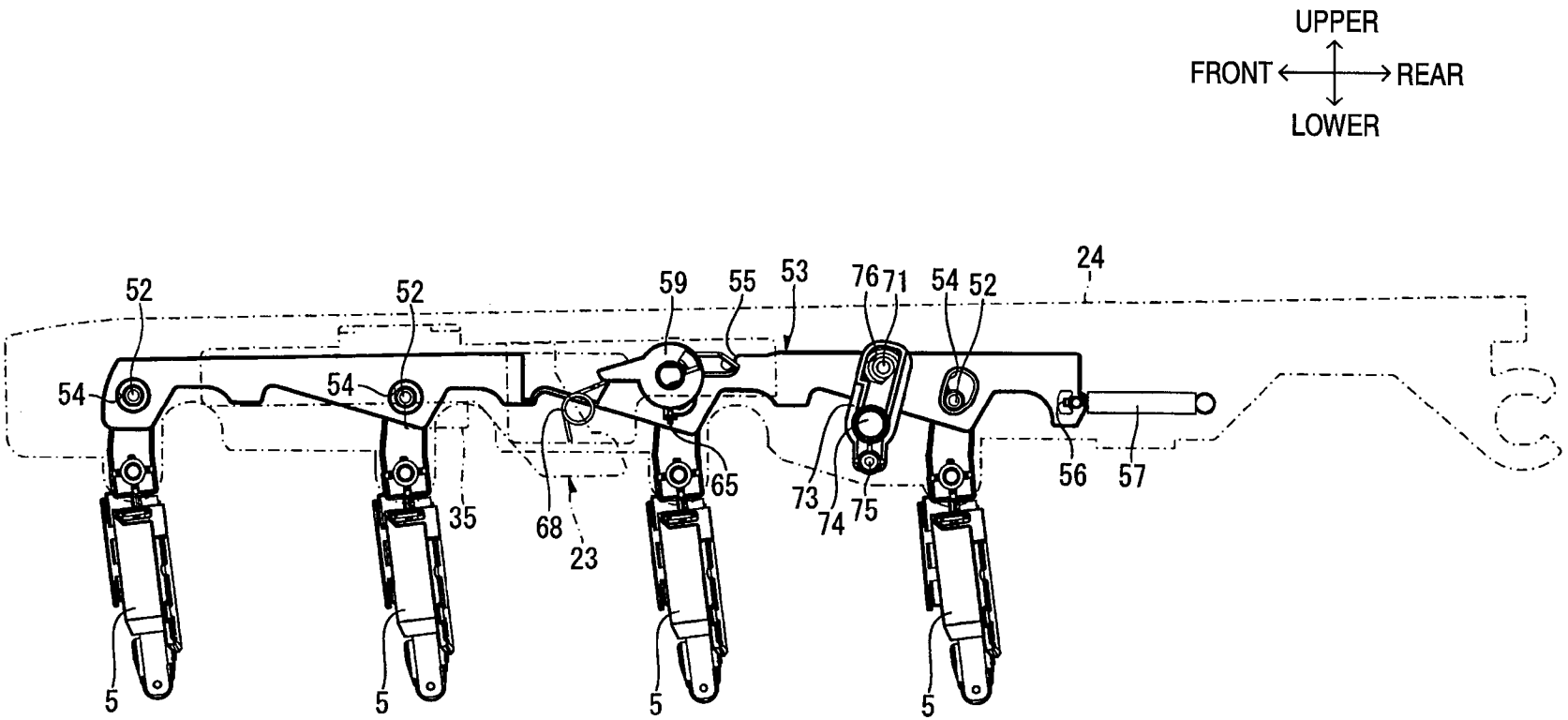
FIG. 13 is a side view showing the movable member and the LED unit when the top cover is in the closed posture.
Figure 14:
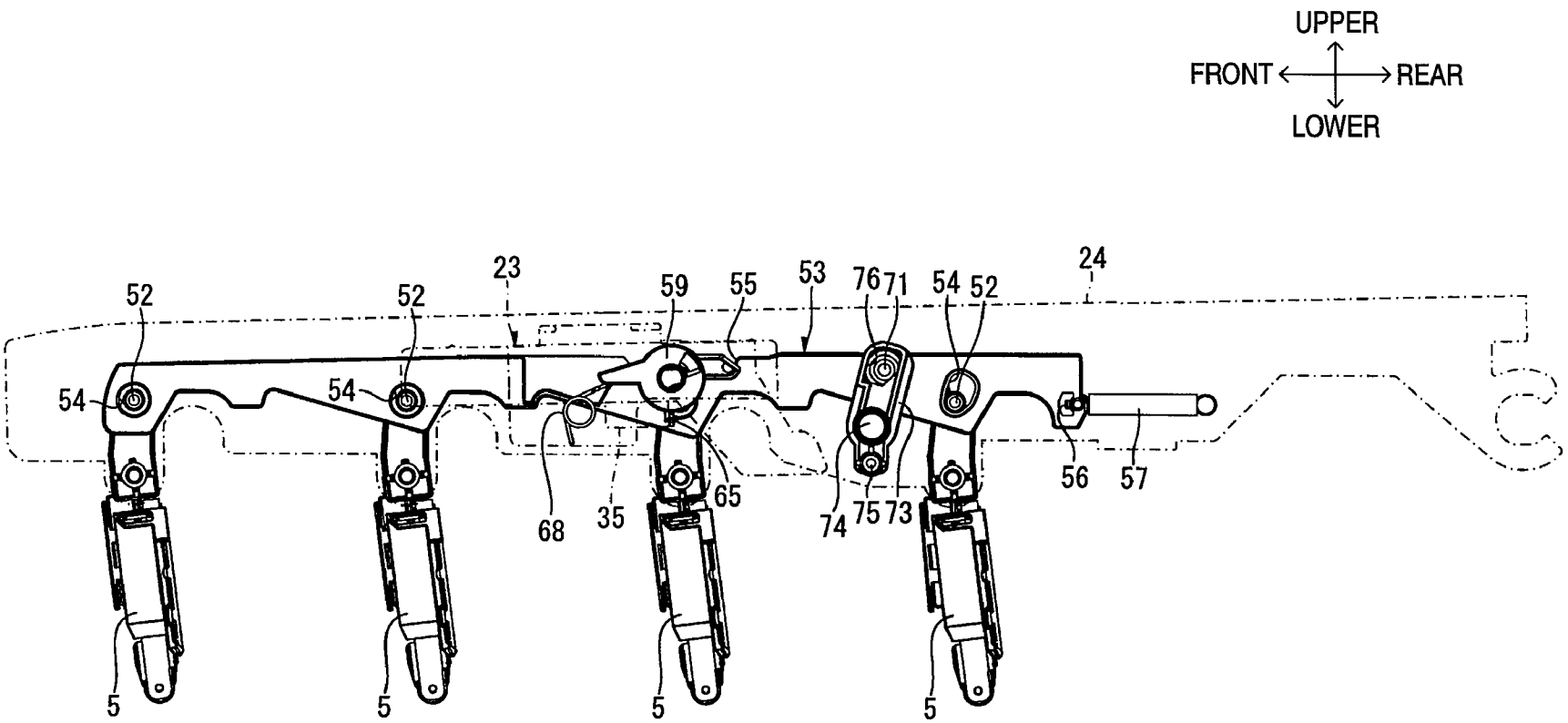
FIG. 14 is a side view showing the movable member and the LED unit when the top cover is disposed at a second angle position rotated by a second angle from the closed posture.

FIG. 11 is a perspective view showing the cover side plate 24 and the movable member 53 when the top cover 4 is in the closed posture. FIG. 12 is a perspective view showing the cover side plate 24 and the movable member 53 when the top cover 4 is in the open posture. FIG. 13 is a side view showing the movable member 53 and the LED unit 5 when the top cover 4 is in the closed posture. FIG. 14 is a side view showing the movable member 53 and the LED unit 5 when the top cover 4 is disposed at the second angle position rotated by the second angle from the closed posture.

Figure 15:
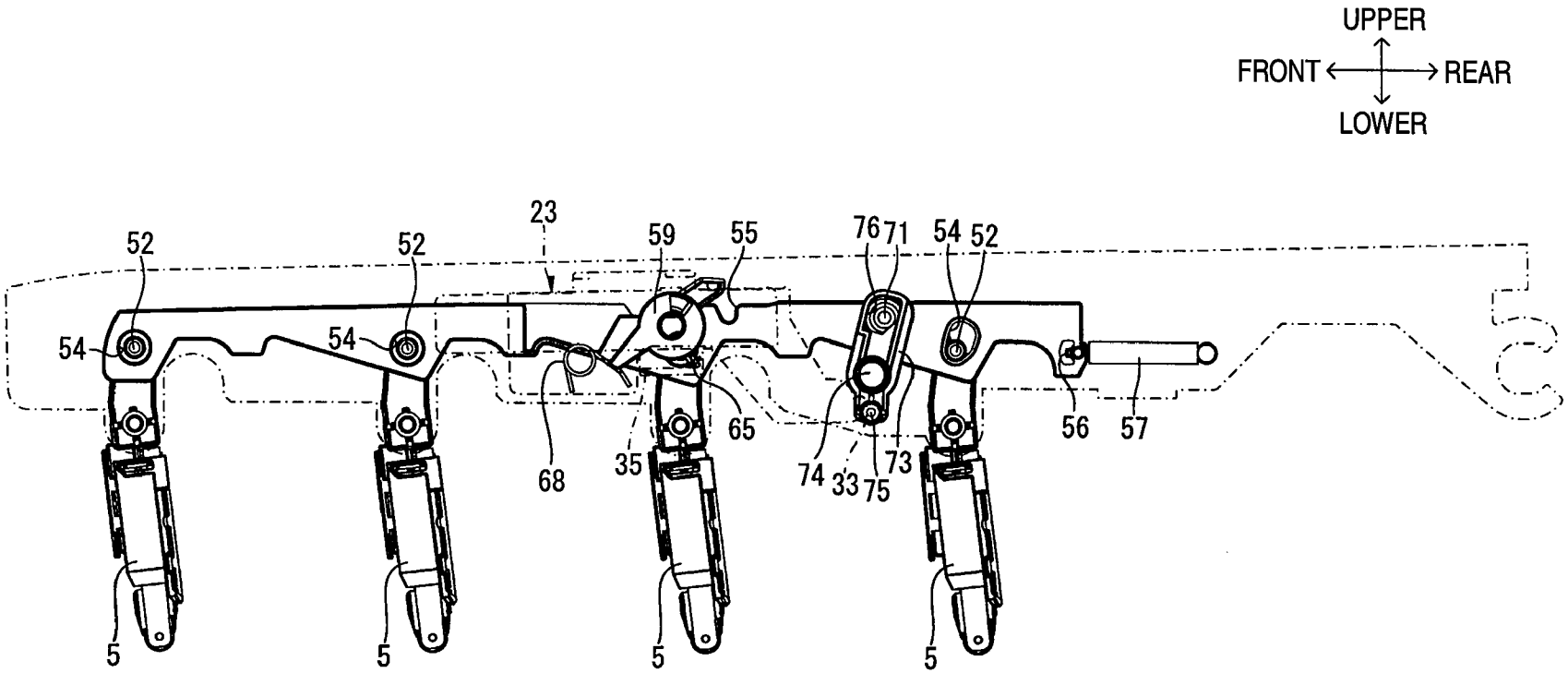
FIG. 15 is a side view showing the movable member and the LED unit when the top cover is disposed at the first angle position rotated by the first angle from the closed posture.
Figure 16:
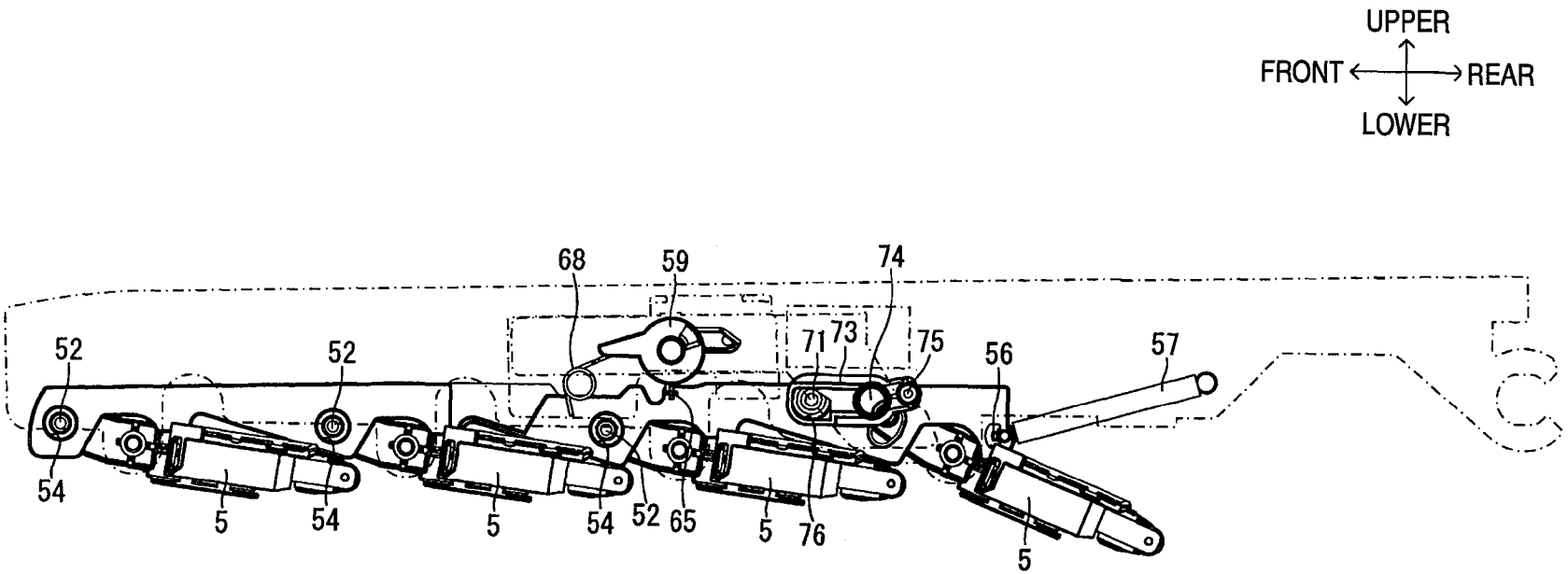
FIG. 16 is a side view showing the movable member and the LED unit when the top cover is in the open posture.
Figure 17:
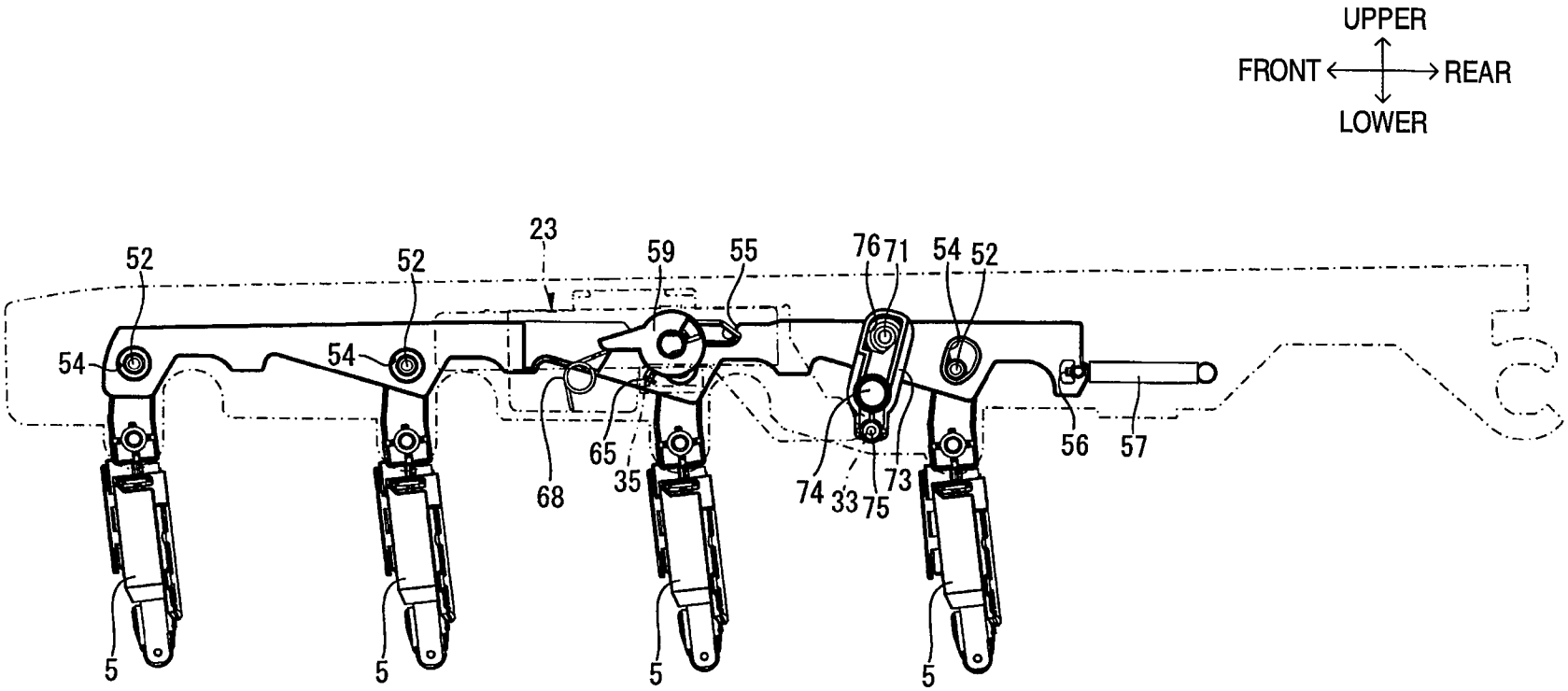
FIG. 17 is a side view showing the movable member and the LED unit when the top cover is disposed at a third angle position rotated by a third angle from the closed posture, from the state of FIG. 16.
Figure 18:
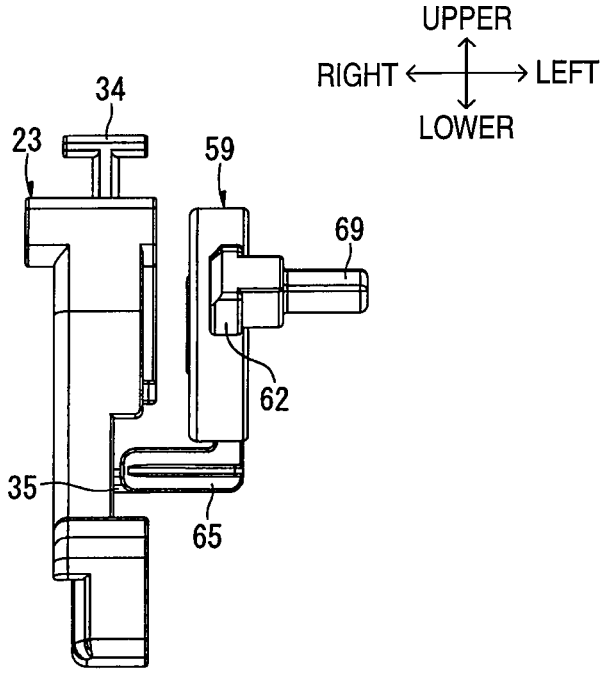
FIG. 18 is a back view showing the positional relationship between a locking member and an operation member.
Figure 19:
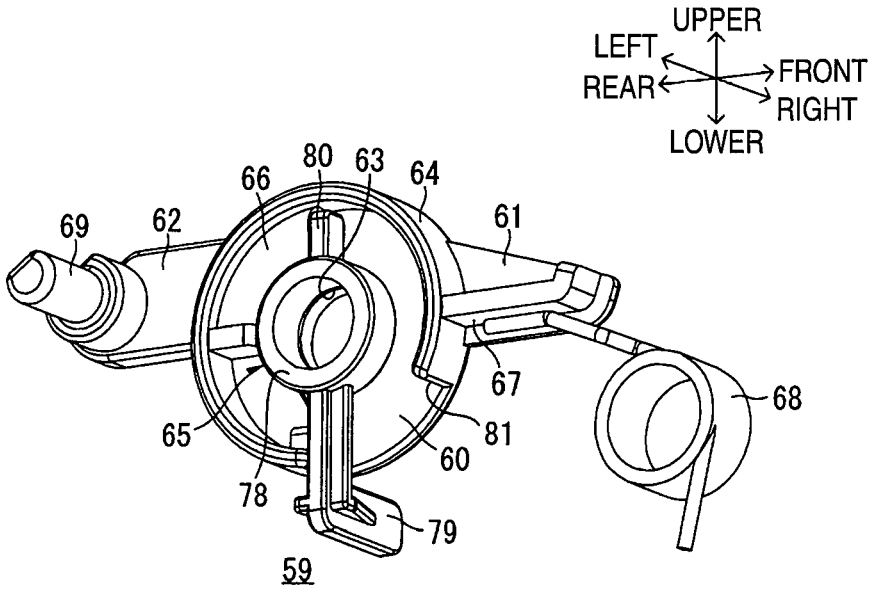
FIG. 19 is a perspective view showing the locking member.

FIG. 15 is a side view showing the movable member 53 and the LED unit 5 when the top cover 4 is disposed at the first angle position rotated by the first angle from the closed posture. FIG. 16 is a side view showing the movable member 53 and the LED unit 5 when the top cover 4 is in the open posture. FIG. 17 is a side view showing the movable member 53 and the LED unit 5 when the top cover 4 is disposed at a third angle position rotated by a third angle from the closed posture, from the state of FIG. 16. FIG. 18 is a back view showing the positional relationship between the locking member 59 and the operation member 23. FIG. 19 is a perspective view showing the locking member 59.

The movable member 53 is formed in an approximately rectangular plate shape in side view extending in the front and rear direction and is disposed on the left side of the right cover side plate 24 as shown in FIG. 11. In the movable member 53, displacement boss holes 54 in which the displacement bosses 52 of the LED unit 5 are inserted are formed at equal distances therebetween in the front and rear direction. A portion of the movable member 53 where each displacement boss hole 54 is formed is formed to have a larger width in the up and down direction than the other portions. In addition, the displacement boss hole 54 located at the rearmost side is formed in an elliptical shape extending in the up and down direction compared with the other three displacement boss holes 54.

A receiving portion 55 having a shape cut from the upper end is formed in a middle portion of the movable member 53 in the front and rear direction. A locking boss 69 (refer to FIG. 19) of the locking member 59, which will be described later, is inserted in the receiving portion 55, such that the movement of the movable member 53 is regulated.

A hook-like spring locking portion 56 that protrudes leftward and is bent frontward is formed at the rear end of the movable member 53. One end of a spring 57 for urging the movable member 53 rearward is locked to the spring locking portion 56, as shown in FIG. 13. In addition, a hook-like spring locking portion 58 that protrudes leftward and is bent rearward is formed in the cover side plate 24 as shown in FIG. 11. The other end of the spring 57 is locked to the spring locking portion 58.

The movable boss 71 protruding rightward is formed between the rearmost displacement boss hole 54 of the movable member 53 and the displacement boss hole 54 positioned therebefore. The movable boss 71 passes through the movable boss hole 72 (refer to FIG. 4) formed in the cover side plate 24 to protrude rightward.

6. Locking Member

The locking member 59 is swingably supported on the right side surface of the right cover side plate 24.

As shown in FIG. 19, the locking member 59 includes a main body portion 60 having an annular plate shape in side view, an urged portion 61 which extends frontward from the peripheral edge of the main body portion 60 and has a triangular shape in side view, and a locking boss support portion 62 which extends rearward from the peripheral edge of the main body portion 60 and has a rectangular shape in side view.

In the main body portion 60, a support shaft hole 63 is formed to pass therethrough in the width direction. A support shaft (not shown) for rotatably supporting the locking member 59 on the cover side plate 24 is inserted in the support shaft hole 63. An annular edge portion 64 extending leftward is formed in the peripheral edge of the main body portion 60. The edge portion 64 is formed in a C shape in side view including an open portion 81 by being cut frontward from the lower end. The main body portion 60 includes a locking lever 65 rotatable around the support shaft hole 63 and a spring 66 for urging the locking lever 65.

The locking lever 65 includes: a rotary portion 78 which has an inner diameter equal to the diameter of the support shaft hole 63, and is provided to be rotatable around the support shaft hole 63, and has an annular plate shape in side view; a spring locking portion 79 extending from the peripheral surface of the rotary portion 78 in a direction perpendicular to the axial line of the support shaft hole 63; and a lever portion 80 extending from the peripheral surface of the rotary portion 78 in a direction opposite the spring locking portion 79.

The end of the spring 66 is locked to the spring locking portion 79. The other end of the spring 66 is locked to the main body portion 60 in a state where a compressive force is applied. Accordingly, an urging force in a clockwise direction as viewed from the left side is always applied to the locking lever 65.

The spring licking portion 79 is formed to protrude outward from the open portion 81 and to be bent to the right side.

The urged portion 61 has an urged surface 67 formed to extend frontward from the outer peripheral surface of the edge portion 64. One end of a coil spring 68, which will be described later, is in contact with the urged surface 67. The locking boss 69 which extends leftward and has a cylindrical shape in side view is formed at the rear end of the locking boss support portion 62. As shown in FIG. 11, the locking boss 69 is inserted in an arc shaped locking boss insertion hole 70 formed in the cover side plate 24 and is fitted in the receiving portion 55 of the movable member 53 in a state where the top cover 4 is closed.

The coil spring 68 is provided between the locking member 59 and the cover side plate 24. As shown in FIG. 13, one end of the coil spring is in contact with the urged portion 61 of the locking member 59 from below. The other end of the coil spring 68 is fixed to the cover side plate 24. Accordingly, an urging force in a direction of rotating the locking member 59 counterclockwise as viewed from the left side is applied to the locking member 59.

7. Link Member

As shown in FIG. 6, a link member 73 is swingably supported on a link shaft 74 provided in the cover side plate 24. The link member 73 is formed to extend in a direction perpendicular to the axial direction of the link shaft 74, and a link boss 75 protruding rightward is formed at one end of the link member 73. In addition, a movable boss hole 76 in which the movable boss 71 is fitted is formed at the other end of the link member 73.

8. Operation of a Movable Member

Hereinafter, an operation of the movable member 53 will be described with reference to FIGS. 13 to 17. In each drawing, the cover side plate 24 and the operation member 23 are shown by imaginary lines for the simplicity purpose.

As shown in FIG. 13, when the top cover 4 is in the closed posture, the operation member 23 is disposed at the front end within a slidable range.

In this state, the movable member 53 is urged rearward by the spring 57. The locking member 59 is urged by the coil spring 68, and the locking boss 69 is fitted in the receiving portion 55 of the movable member 53. The tip of each LED unit 5 is separated from the top cover 4 to be disposed at a distant position at which the LED unit 5 can expose the surface of the photoconductor drum 6 (refer to FIG. 1).

When the top cover 4 rotates toward the second angle position rotated by the second angle (for example, 35°) from the above state, the operation member 23 moves rearward and the L rib 35 comes in contact with the locking lever 65 of the locking member 59 from the front side as shown in FIG. 14. When the top cover 4 further rotates from this state, the locking boss 69 is separated from the receiving portion 55. That is, the lower end of the locking lever 65 is pressed rearward against the L rib 35, the lever portion 80 (refer to FIG. 19) comes in contact with the edge portion 64 (refer to FIG. 19), and the locking member 59 rotates counterclockwise as viewed from the right side. Then, the locking boss 69 (refer to FIG. 19) moves in a direction of being lifted upward. As a result, regulation of movement of the movable member 53 is released. In addition, the urged portion 61 (refer to FIG. 19) moves in a direction of being pressed downward. Accordingly, a compressive force is applied to the coil spring 68. In addition, when the top cover 4 is disposed at the first angle position rotated by the first angle (for example, 40°) from the closed posture, the contact portion 33 of the operation member 23 comes in contact with the link boss 75 of the link member 73 from the front side thereof, as shown in FIG. 15. From this state, when the top cover 4 further rotates, the contact portion 33 of the operation member 23 presses the link boss 75 of the link member 73 pressed rearward. Then, each LED unit 5 starts to rotate around the LED support hole 29. That is, the link boss 75 rides on the contact portion 33 of the operation member 23 by further rearward movement of the operation member 23. Then, the link member 73 rotates around the link shaft 74 to move the movable member 53 downward to the front side through the movable boss 71. As a result, each LED unit 5 rotates around the LED support hole 29 and the other end faces toward the rotatable shaft 15 (refer to FIG. 1).

After the lower end of the locking lever 65 moves ahead of the L rib 35 in a state (state of FIG. 15) of being pressed rearward by the L rib 35, the lower end of the locking lever 65 is separated from the L rib 35 as shown in FIG. 16. Then, the coil spring 68 to which the compressive force has been applied is restored, and accordingly, the locking member 59 rotates clockwise as viewed from the right side.

When the top cover 4 is rotated to a third angle position rotated by the third angle (for example, 40°) from the open posture, the operation member 23 moves frontward and the link boss 75 is separated from the contact portion 33 as shown to FIG. 17. Then, the movable member 53 moves upward to the rear side by the urging force of the spring 57. As a result, each LED unit 5 rotates around the LED support hole 29 and the other end is disposed at a distant position separated from the top cover 4.

The locking boss 69 of the locking member 59 is fitted into the receiving portion 55 of the movable member 53 simultaneously when the link boss 75 is separated from the contact portion 33. As a result, movement of the movable member 53 is regulated.

9. Operations and Effects

As described above, the opening 16 is formed in the main body casing 2. The top cover 4 is attached to the main body casing 2. The top cover 4 is rotatably supported around the rotatable shaft 15. The opening 16 of the main body casing 2 is opened when the top cover 4 is in the open posture and is closed when the top cover 4 is in the closed posture. One end of each LED unit 5 is swingably supported on the top cover 4. When the top cover 4 is in the closed posture, the LED unit 5 takes the distant posture in which the other end opposite the one end is distant from the top cover 4. As the top cover 4 is rotated from the first angle position at which the top cover 4 is rotated by the first angle from the closed posture, toward the open posture, the LED unit 5 swings from the distant posture toward an adjacent posture, in which the other end is more close to the top cover 4 than the distant posture. As the top cover 4 is rotated toward the first angle position from the open posture, the LED unit 5 is rotated toward the distant posture with the rotation. As the top cover 4 is rotated toward the closed posture from the second angle position at which the top cover 4 is rotated by the second angle from the closed posture, the swingable range of the LED unit 5 is regulated by the locking member 59. Thus, it is possible to prevent undesired swinging of the LED unit 5, which is large sufficient to cause interference with other components disposed in the main body casing 2 when the top cover 4 rotates from the open posture to the closed posture. Accordingly, interference between the LED unit 5 and components disposed in the main body casing 2 can be prevented.

Furthermore, the photoconductor drum 6 is housed in the main body casing 2. The LED unit 5 includes an exposure device for exposing a surface of the photoconductor drum 6. Since the LED unit 5 faces the surface of the photoconductor drum 6 when the top cover 4 is in the closed posture, the surface of the photoconductor drum 6 can be exposed by the LED unit 5.

In addition, when the top cover 4 rotates from the closed posture toward the open posture, the swingable range of the LED unit 5 is regulated by the locking member 59 until passing the second angle position at which the top cover 4 is rotated by the second angle from the closed posture. In addition, when the top cover 4 is rotated to pass the third angle position toward the open posture side, the regulation performed by the locking member 59 is released so that the LED unit 5 freely swings. Accordingly, when the top cover 4 is rotated from the closed posture toward the open posture, undesired swinging of the LED unit 5 can be prevented until passing the second angle position and rotation of the LED unit 5 from the distant posture to the adjacent posture can be allowed after passing the second angle position. As a result, satisfactory rotation of the LED unit 5 from the distant posture to the adjacent posture can be secured while preventing the interference between the LED unit 5 and components disposed in the main body casing 2 when the top cover 4 rotates from the closed posture toward the open posture.

In addition, the LED unit 5 is supported by the movable member 53. When the movable member 53 moves in a direction perpendicular to the rotatable shaft 15, the LED unit 5 swings. The locking member 59 regulates the amount of movement of the movable member 53. Accordingly, the swingable range of the LED unit 5 can be regulated.

Moreover, if the top cover 4 is rotated from the open posture to the third angle position and is disposed at the third angle position, the LED unit 5 takes the distant posture and the amount of movement of the movable member 53 is regulated by the locking member 59. Thus, the swingable range of the LED unit 5 can be regulated simultaneously when the LED unit 5 takes distant posture.

The arm 21 is provided between the main body casing 2 and the top cover 4. One end of the arm 21 is rotatably supported on the main body casing 2. On the other hand, the other end of the arm 21 opposite the one end is slidably connected to the top cover 4 in a direction perpendicular to the rotatable shaft 15. Accordingly, since the top cover 4 is provided to be rotatable with respect to the main body casing 2, the other end of the arm 21 slides in conjunction with the displacement between the open posture and the closed posture of the top cover 4. The locking member 59 regulates the amount of movement of the movable member 53 and releases the regulation in conjunction with sliding of the other end of the arm 21. Accordingly, regulation of the amount of movement of the movable member 53 and release of the regulation can be reliably switched in conjunction with the displacement between the open posture and the closed posture of the top cover 4.

Further, the locking member 59 has a projection. And, a receiving portion in which a projection is received is formed in the movable member 53. The amount of movement of the movable member 53 is regulated by receiving of the locking boss 69 into the receiving portion 55, and regulation of the amount of movement of the movable member 53 is released by separation of the locking boss 69 from the receiving portion 55. Accordingly, regulation of the amount of movement of the movable member 53 and release of the regulation can be realized with a simple configuration of the locking boss 69 and the receiving portion 55.

Further, the receiving portion 55 is formed at a position facing the locking boss 69 simultaneously with disposition of the top cover 4 at the third angle position when the top cover 4 is rotated toward the third angle position from the open posture. Accordingly, it is possible to regulate the amount of movement of the movable member 53 simultaneously when the top cover 4 is disposed at the third angle position.

In addition, the locking member 59 has the locking lever 65 and the locking boss 69 that are integrally formed. The printer 1 includes the operation member 23. The operation member 23 operates the locking lever 65 to separate the locking boss 69 from the receiving portion 55 in conjunction with the displacement of the top cover 4 between the closed posture and the open posture. Accordingly, regulation of the amount of movement of the movable member 53 can be released in conjunction with the displacement of the top cover 4.

In addition, the movable member 53 is urged in a direction of becoming adjacent to the rotatable shaft 15 by the spring 57. Since such an urging force is applied to the movable member 53, the amount of movement of the movable member 53 is regulated. Accordingly, it can be prevented that the movable member 53 largely vibrates in a direction of becoming adjacent to the rotatable shaft 15 and a direction becoming distant from the rotatable shaft 15. Therefore, undesired swinging of the LED unit 5 can be suppressed.

In addition, the four LED units 5 are provided. The movable member 53 holds the four LED units 5 collectively. Accordingly, the four LED units 5 can be displaced to the distant posture and the adjacent posture collectively by moving the movable member 53.

In the above-described exemplary embodiment, the third angle is larger than the second angle. However, the present invention is not limited thereto. The third angle may be same as the second angle.

While the present invention has been shown and described with reference to certain exemplary embodiments thereof, it will be understood by those skilled in the art that various changes in form and details may be made therein without departing from the spirit and scope of the invention as defined by the appended claims.

What is claimed is:

1. An image forming apparatus comprising:

a first body formed with an opening;

a second body which is supported on the first body, and which is rotatable about an axis between an open posture in which the opening is opened and a closed posture in which the opening is closed;

a swingable member which comprises one end swingably supported on the second body, and another end opposite to the one end, wherein the swingable member takes a distant posture in which the other end is distant from the second body when the second body is in the closed posture, wherein as the second body is rotated from a first angle position at which the second body is rotated by a first angle from the closed posture, toward the open posture, the swingable member swings from the distant posture toward an adjacent posture in which the other end is closer to the second body than the distant posture, and wherein as the second body is rotated from the open posture toward the first angle position, the swingable member swings toward the distant posture; and a regulating mechanism which regulates a swingable range of the swingable member when the second body is rotated from a third angle position at which the second body is rotated by a third angle from the closed posture, toward the closed posture, wherein when the second body is rotated from the closed posture toward the open posture, the regulating mechanism regulates the swingable range of the swingable member between the closed posture and a second angle position at which the second body is rotated from the closed posture by a second angle, and releases the regulation of the swingable range of the swingable member between the second angle position to the open posture.

2. The image forming apparatus according to claim 1, further comprising a photoconductor housed in the first body, wherein the swingable member includes an exposure device which is configured to expose a surface of the photoconductor.

3. The image forming apparatus according to claim 1, further comprising a movable member which supports the swingable member, and which is movable in a direction perpendicular to the axis for the swingable member to swing, wherein the regulating mechanism regulates the swingable range of the swingable member by regulating an amount of movement of the movable member.

4. The image forming apparatus according to claim 3, wherein when the second body is rotated from the open posture toward the third angle position, the swingable member takes the distant posture and the regulating mechanism starts to regulate the amount of movement of the moveable member simultaneously when the second body is disposed at the third angle position.

5. The image forming apparatus according to claim 3, further comprising:

an arm which is provided between the first body and the second body, the arm comprising one end which is rotatably supported on the first body, and another end opposite to the one end, which is connected to the second body slidably in a direction perpendicular to the axis, wherein the regulating mechanism regulates the amount of movement of the movable member and releases the regulation in conjunction with sliding of the arm with respect to the second body.

6. The image forming apparatus according to claim 3, further comprising:

an urging member which urges the movable member in a direction to be close to the axis.

7. The image forming apparatus according to claim 3, wherein a plurality of the swingable members are provided, and wherein the movable member supports the plurality of swingable members collectively.

8. The image forming apparatus according to claim 3, wherein the regulating mechanism comprises a projection, and wherein the movable member is formed with a receiving portion in which the projection is received.

9. The image forming apparatus according to claim 8, wherein when the second body is rotated from the open posture toward the third angle position, the receiving portion faces the projection at a timing when the second body is disposed at the third angle position.

10. The image forming apparatus according to claim 8, wherein the regulating mechanism comprises a lever provided integrally with the projection, the image forming apparatus further comprising an operation member which causes the lever to separate the projection from the receiving portion in conjunction with rotation of the second body.

11. An image forming apparatus comprising:

a first body comprising an opening and a shaft provided at one end of the opening;

a second body rotatably supported by the shaft between an open posture in which the opening is opened and a closed posture in which the opening is closed;

an operation member which is slidably supported on the second body;

an arm comprising one end which is connected to the first body and another end opposite to the one end, the other end connected to the operation member to be slidable with respect to the second body;

a movable member which is movably supported on the second body, and includes an engagement part, wherein the movable member is moved by the operation member;

a swingable member comprising a first portion rotatably supported on the second body and a second portion rotatably supported on the movable member; and a regulating mechanism which is moved by contacting the operation member, and includes an engagement part engageable with the engagement part of the movable member.

12. The image forming apparatus according to claim 11, further comprising a link member which is rotatably supported on the second body, wherein the link member comprises a first end connected to the movable member and a second end which is contactable to the operation member slid with respect to the second body so that the link member is rotated to move the movable member.

* * * * *